United States Patent [19]

Horimatsu

[11] Patent Number: 4,610,572

[45] Date of Patent: Sep. 9, 1986

[54] METHOD OF BUILDING STRENGTHENED EMBANKMENT BODY

[75] Inventor: Kazuo Horimatsu, Funabashi, Japan

[73] Assignee: Tekken Construction Co., Ltd., Tokyo, Japan

[21] Appl. No.: 770,563

[22] Filed: Aug. 29, 1985

[51] Int. Cl.[4] ..... E21D 9/00

[52] U.S. Cl. ..... 405/258; 405/132; 405/138; 405/146; 405/150

[58] Field of Search ..... 405/132, 149, 260, 284, 405/138, 141, 258

[56] References Cited

U.S. PATENT DOCUMENTS

| | | | |
|---|---|---|---|
| 678,605 | 7/1901 | Wolcott et al. | 405/124 |
| 4,329,089 | 5/1982 | Hilfiker et al. | 405/262 |
| 4,413,928 | 11/1983 | Tucker | 405/260 |
| 4,519,730 | 5/1985 | Horimatsu | 405/258 |

FOREIGN PATENT DOCUMENTS

| | | | |
|---|---|---|---|
| 2138057 | 10/1984 | United Kingdom | 405/132 |

*Primary Examiner*—Cornelius J. Husar
*Assistant Examiner*—Kristina I. Hall
*Attorney, Agent, or Firm*—Leydig, Voit & Mayer, Ltd.

[57] ABSTRACT

A method of building a strengthened embankment body which involves the steps of repeatedly burying first nets and embanking and roll-compacting the body being built on ground until a required height of embankment is reached, repeatedly burying of second nets between the buried first nets and embanking and roll-compaction of compression-resistive materials are concurrently repeated to form a highly strengthened arched body part locally at a zone corresponding to an arched peripheral wall of a semi-cylindrical tunnel to be excavated through the body, the first buried nets providing the stability of the entire embankment body while the second buried nets achieving the stability at the arched peripheral wall zone of the tunnel.

7 Claims, 4 Drawing Figures

METHOD OF BUILDING STRENGTHENED EMBANKMENT BODY

TECHNICAL BACKGROUND OF THE INVENTION

This invention relates to methods of building strengthened embankment bodies and, more particularly, to an improved method of building the strengthened embankment body in which specifically a peripheral wall zone of a tunnel to be excavated through the embankment body is previously strengthened.

When such a new road as a high way is constructed to intersect already existing roads, rivers, water-ways or the like, in general, there has been employed such a method of constructing the new road in a two level crossing with respect to the existing road or the like by forming the new road with an embankment. In this case, it is necessary to build a structure transversely through the embankment so as to secure a space necessary for retaining the existing road or the like. The structure to be thus built in the embankment includes specifically concrete-made tunnel wall structures, substructures for a bridge, box structure or the like, and peripheral portions of the structure in the embankment must be sufficiently stabilized so as to prevent its side walls and ceiling from being collapsed or broken.

DISCLOSURE OF PRIOR ART

The two level crossing has been practiced according to the known method in such a manner as shown in FIG. 1, in which, when a new road NR is constructed, a hollow buried structure SB for defining a tunnel is initially built as reinforced by a concrete wall or the like over each of, for example, an existing old road OR and a water-way WR, and thereafter an embankment is to be constructed further over the structures SB for the new road construction but, in order to transport embanking materials to the site of the new road, it is necessary to provide preparatory construction roads PR leading to respective parts of the site between the old road OR and water-way WR and beyond the former.

According to this known method, however, the embanking work for the new road construction must be performed after sufficient hardening of such material of the structure SB as concrete because, at each time when the new road crosses each existing road or the like, the structure SB must be built prior to the new road construction, and it has been impossible to continuously construct the new road but only intermittently, so that the construction period could be prolonged. Yet, the provision of the preparatory construction road PR has been necessary since otherwise the construction period has to be further prolonged due to that the thus intermittently made new road must be utilized for the embanking material transportation, but such provision has been requiring a larger amount of costs and even occasionally is impossible for geographic reasons.

To eliminate the above problems, the present inventor has proposed earlier such embanking methods as has been disclosed in U.S. Pat. No. 4,519,730 (or British Patent Application No. 8401322) and U.S. patent application Ser. No. 602,077 (or British Patent Application No. 8409638), the former of which is particularly featured in comprising the steps of burying a plurality of nets as vertically spaced from each other while forming at least slope layers of an embankment including side wall parts of a tunnel to be therein excavated later, and forming a crushed-stone layer between transversely opposed pairs of supporting plates as prestressed in the upper ceiling part of the later excavated tunnel, whereas the latter of which is featured in particular in comprising the steps of burying also a plurality of nets of vertically spaced at least in the slope layers of the embankment including the side wall parts of the later excavated tunnel, forming an arch-shaped crushed-stone layer enclosing the both side and upper ceiling parts of the later formed tunnel, and providing a hanging force to the ceiling part with the crown portion of the crushed-stone layer used as a support means.

These earlier proposed methods can solve the problems involved in the known method of constructing new road as in FIG. 1 and attain the intended objects, but they require the separate steps of strengthening both of the side wall and upper layer zones of the tunnel to be excavated in the embankment being built and, while the embanking could have been simplified to a large extent in contrast to the method of FIG. 1, a further simplification of the method has been a general demand. Yet, in the case of the earlier proposed methods, further problems still should arise in such that the step of forming the crushed-stone layer between the prestressed supporting plates becomes complicated in the former method particularly when the tunnel to be excavated is large in the diameter, the arch-shaped crushed-stone layer in the latter method requires to have the embankment made sufficiently high enough for therein embedding the crown part of the layer which reaches considerably high above the tunnel ceiling.

TECHNICAL FIELD OF THE INVENTION

A primary object of the present invention is, therefore, to provide a method of building a strengthened embankment body, which can be performed continuously across existing road or the like without requiring any preparatory construction road, and is simplified in required step for strengthening the body specifically at its part where a tunnel, for example, of a larger diameter is to be made, while reducing required height of the embankment, as well as the construction period and costs respectively to a large extent.

According to the present invention, the above object can be realized by providing a method of building a strengthened embankment body for constructing a new road in which a tunnel is to be excavated, the method comprising the steps of embanking required materials for constructing the new road while horizontally burying a plurality of first nets as vertically spaced from each other, and preparing in the body being embanked a semicylindrical zone capable of being tunneled, the preparing step including a step of forming, during the embanking step, an arch-shaped strengthened body part corresponding to an arch-shaped peripheral wall part of the semicylindrical zone, the step of forming the arch-shaped strengthened body part including further steps of preparing embanking material highly compression-resistant, and burying a plurality of second nets with the highly compression-resistant embanking material in the arch-shaped wall part of the zone as vertically spaced and between the respective first nets being buried, the second nets being buried at a density increased as they approach the top of the arch of the strengthened body part and having respectively a width substantially equal to the width of the strengthened body part.

Other objects and advantages of the present invention shall become clear from the following description of the invention detailed with reference to a preferred embodiment shown in accompanying drawings.

Figure 1:
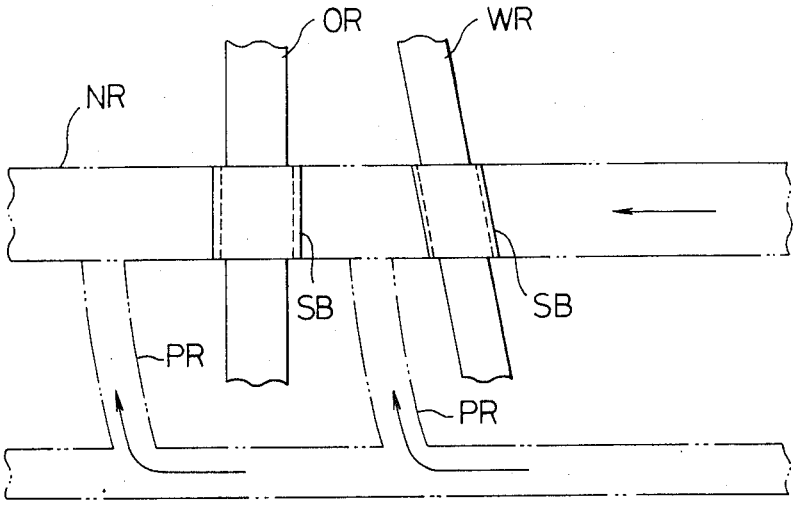
FIG. 1 is a schematic diagram for explaining a conventional method of constructing a new road.

While the present invention shall now be described with reference to the preferred embodiment shown in the drawings, it should be understood that the intention is not to limit the invention only to the particular embodiment shown but rather to cover all alterations, modifications and equivalent arrangements possible within the scope of appended claims.

DISCLOSURE OF PREFERRED EMBODIMENT

Figure 2:
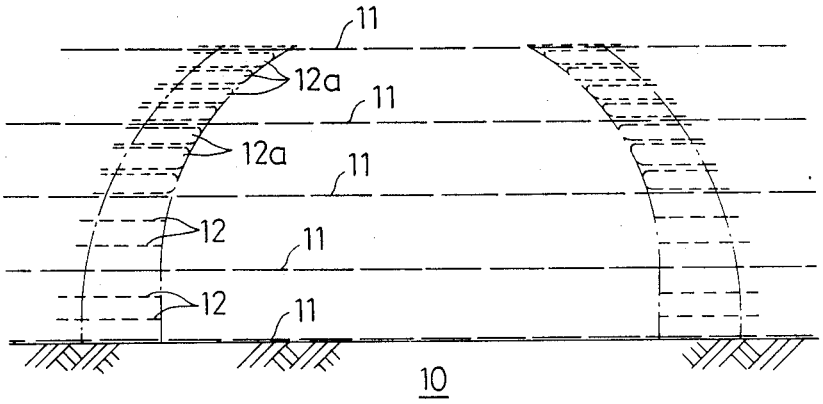
FIG. 2 is a diagram for explaining, in a fragmentary section, the embankment body being built through the steps of embanking the required material for constructing a new road and burying the first and second nets to form the arch-shaped strengthened body part which is shown in its incompleted state in an embodiment of the method according to the present invention.

The method of building a strengthened embankment body capable of being tunneled according to the present invention shall be detailed with reference to FIGS. 2 and 3. Referring in particular to FIG. 2, a wide buried net 11 for the lowest level are initially placed horizontally on a ground 10 preferably over the entire area at the site of building the embankment body, thereafter earth or the like embanking material is embanked to a predetermined height, and the embanked material is sufficiently roller-compacted into a solid bed. The buried nets 11 for second level are placed on the thus formed bed, and the embanking and roller-compaction are similarly repeated over the second level nets. In this case, the buried nets 11 of the respective levels are vertically spaced substantially at a regular interval of preferably 40–60 cm. For the net 11, polyethylene threads having a tensile elastic modulus of 7.0 Kg/cm$^2$ are meshed to provide a grid of 2.5 to 3.0 cm and to have an allowable tensile-resisting stress of about 1.000 Kg/m. The embanking work is repeated while burying the nets 11 and applying the sufficient roller-compaction, until a required height of the embankment is reached.

Simultaneously with the thus repeated embanking works, a zone corresponding to an arch-shaped peripheral wall part of a tunnel to be excavated in the embankment body is formed as a strengthened part of the body. In forming such strengthened body part, a highly compression-resistant embanking material is used in the particular zone and a plurality of slope nets 12 are horizontally buried at different levels between the buried nets 11 of the respective levels. The compression-resistant embanking material may be gravel and the like for a low earth pressure or crushed stone and the like for a high earth pressure. While forming each of the beds between the spaced buried nets 11 at the respective levels, the slope nets 12 for a lower level are horizontally laid and the embanking is made mainly with the compression-resistant material on the nets 12 together with the embanking of other parts while providing the sufficient roller-compaction to form a part of each bed. Further slope nets 12 for a next higher level are laid on the compacted material part and the embanking is repeated with the roller-compaction to form each bed. For the slope net 12, preferably, the polyethylene threads, thinner than the threads of the buried net 11, are meshed to provide a grid smaller than the buried net 11 and to have an allowable tensile-resisting stress of about 500 Kg/m.

According to a remarkable feature of the present invention, the strengthened body part corresponding to the peripheral wall part of the tunnel to be made semicylindrically in the embankment body is formed, as the embanking advances, in such an arch shape 13 as defined by a pair of chain lines in the drawings. In other words, the laying of the slope nets 12 and embanking with the highly compression-resistant material as roller-compacted are performed between the respective widely spread buried nets 11 so that the nets 12 and compression-resistant material as a whole will form an arch in section. In this case, the slope nets 12 are laid preferably to extend out of the arch shape 13 by about, for example, 20–30 cm on outer side opposite to the tunnel to be made. As such embanking work advances to the top part of the arch-shaped strengthened body part 13, that is, as the overhang degree of the arch becomes high, the vertical spacing between the slope nets 12*a* and 12*b* in such overhanging parts is made gradually smaller. It is most preferable that these slope nets 12*a* and 12*b* in the overhanging parts are folded into a U-shape and are buried with their central folded part disposed on the inner side along the peripheral wall of the tunnel and both leg parts disposed on the outer side, whereby, it has been found, the arch-shaped body part 13 is strengthened to a large extent. As the overhang degree increases and the top of the arch-shape approaches, the folding curvature of the slope nets is raised to lay their both leg parts closer to each other. In forming the top area of the arch-shaped strengthened body part 13, the slope nets 12 may be buried at a high density but, because the earth pressure of the top area as well as the embanked bed zone above the tunnel to be made is supported by both side portions of the arch-shaped strengthened body parts 13, it is sufficient to bury only the widely spread buried nets 11 at a higher density. Further, the buried nets 11 are desirably so buried that an imaginary line connecting their outer ends will draw in section a shape similar to the outline of the tunnel.

Figure 3:
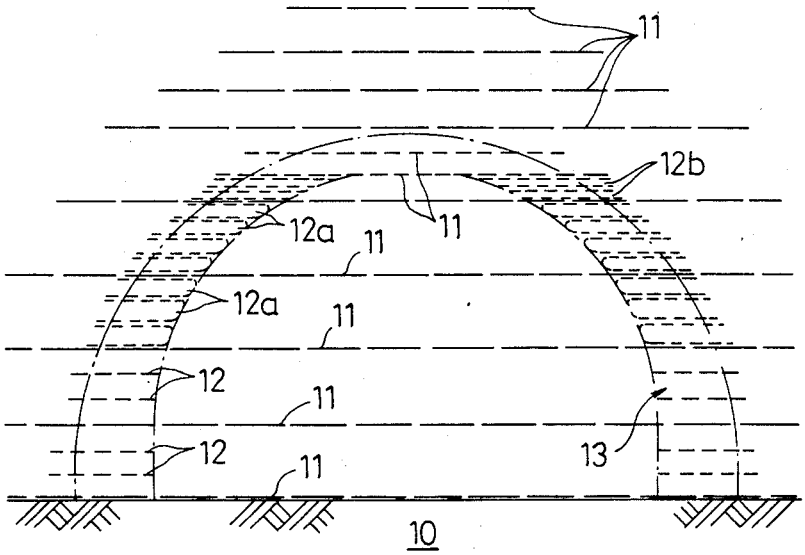
FIG. 3 is a diagram similar to FIG. 2 but in a state in which the arch-shaped strengthened body part is completed.
Figure 4:
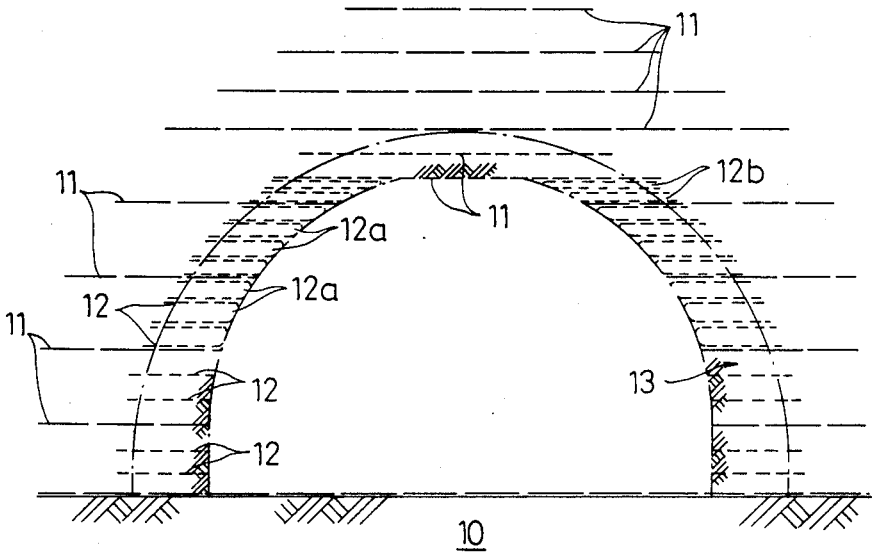
FIG. 4 is a diagram similar to FIG. 3 but in a state in which a tunnel has been excavated through a zone enclosed by the arch-shaped strengthened body part.

After completion of the embanking works to the state shown in FIG. 3, the embanked beds inside the arch-shaped strengthened body part 13 is removed, cutting off the buried nets 11 at their portions disposed inside the body part 13, and the semicylindrical tunnel is excavated in such that the inner peripheral surface of the arch-shaped strengthened body part 13 forms the peripheral wall surface of the tunnel.

The operation of the strengthened embankment body built according to the method of the present invention shall be detailed. According to the method, the embankment body can be well stabilized all over the zone in which the buried nets 11 are lying. This is because the embanking material passed through the grids of the buried nets 11 forms microscopically columns in the respective grids, through which columns the buried nets 11 are tightly coupled to the embanking material.

That is, when a sliding force is caused to occur in the tunnel wall exposed during the tunnel excavation due to the earth pressure in the embankment body, then the buried nets 11 are subjected to a tensile force and a shearing force is transmitted through the column-shaped embanking material in the respective grids to the entire embankment body, whereby independent behavior of the embanking material can be effectively restrained and the stability of the entire embankment body can be maintained.

During the tunnel excavation, it tends to incur a cave-in or collapse particularly at the peripheral wall surface of the tunnel. According to the present method, however, the zone corresponding to the arch-shaped peripheral wall part of the semicylindrical tunnel is made as the arch-shaped strengthened body part 13, the slope nets 12 are buried in addition to the buried nets 11 in the arch-shaped body part 13 with the gradually reduced spacing as the top part of the arch-shape approaches and the risk of collapse increases, and a binding force of the slope nets with the compression-resistant embanking material is increased to a large extent. As a result, the embanked material at the peripheral wall part of the tunnel can be prevented from behaving independently, the embanked material even at the critical area in the tunnel wall can be prevented substantially from falling during and after the tunnel excavation, the arch-shaped body part 13 will not be subjected to any bending force, and the arch-shaped peripheral wall part can sufficiently resist any collapsing force due to the earth pressure in the embankment body. It will he readily understood by those skilled in the art that, since the arch-shaped strengthened body part 13 is rigid without any sliding, the body part 13 can function substantially as a sort of concrete structure, and an additional application of any reinforcing material onto the peripheral wall surface of the tunnel can be made unnecessary.

According to the method of the present invention as has been disclosed, the embanked beds right above the tunnel already formed in the strengthened embankment body can be sufficiently utilized for transporting the embanking material with any heavy vehicles so as to continuously construct the new road over any existing old road, water-ways and so on just as in the case of the earlier proposed methods, so that it is made unnecessary to provide any preparatory construction road, and the construction period and eventually the construction costs can be well shortened. In addition, the required steps for the road construction can be further simplified than the earlier proposed methods, the height of the embankment can be minimized and the construction costs can be further reduced.

What is claimed as my invention is:

1. A method of building a strengthened embankment body for constructing a new road in which a tunnel is to be excavated, the method comprising the steps of embanking required material for constructing the new road while horizontally burying a plurality of first nets which are vertically spaced from each other, and preparing in said body being embanked a semicylindrical zone capable of being tunneled, said preparing step including a step of forming, during said embanking step, an arch-shaped strengthened body part corresponding to an arc-shaped peripheral wall part of said semicylindrical zone, said step of forming said arch-shaped strengthened body part including further steps of preparing embanking material highly compression-resistant, and burying a plurality of second nets with said highly compression-resistant embanking material between said second nets, said second nets buried in said arch-shaped wall part of said zone being vertically spaced and between said respective first nets, at a density increased as they approach the top of the arch of the strengthened body part and having respectively a width substantially equal to the width of the strengthened body part.

2. A method according to claim 1, wherein said second nets are buried at a density gradually increased as they approach said top of said arch-shaped strengthened body part.

3. A method according to claim 2, wherein said first and second nets respectively comprise meshed polyethylene threads, and the second nets are smaller in thread diameter and grid size than the first nets.

4. A method according to claim 2, wherein said second nets buried in top area of said arch-shaped strengthened body part are folded respectively into an U shape and buried with their central folded part disposed along the inner surface of said arch-shaped peripheral wall part and their both end parts disposed on the side of the outer surface of the peripheral wall part of said tunnel to be excavated.

5. A method according to claim 4, wherein folding curvature of said second nets is increased as they approach said top of said arch-shaped strengthened body part.

6. A method according to claim 2, wherein said compression-resistant embanking material is crushed stone.

7. A method according to claim 2, wherein said compression-resistant embanking material is gravel.

* * * * *